United States Patent [19]

Janowitz

[11] Patent Number: 4,903,865

[45] Date of Patent: Feb. 27, 1990

[54] PUSH BUTTON CAP CONTAINING AN ADDITIVE FOR CONTAINERS

[76] Inventor: C. Michael Janowitz, 303 Fifth Ave., New York, N.Y. 10016

[21] Appl. No.: 245,694

[22] Filed: Sep. 19, 1988

[51] Int. Cl.[4] ..... B67B 7/24

[52] U.S. Cl. ..... 222/83.5; 222/129; 222/541; 206/222; 604/416

[58] Field of Search ..... 222/80, 541, 547, 551, 222/81, 83, 83.5, 88, 129; 206/222; 220/277, 20; 604/415, 416

[56] References Cited

U.S. PATENT DOCUMENTS

| | | | |
|---|---|---|---|
| 2,275,567 | 3/1942 | Smith | 206/47 |
| 3,354,883 | 11/1967 | Southerland | 222/80 X |
| 3,443,726 | 5/1969 | Muller et al. | 222/80 |
| 3,603,469 | 9/1971 | Magni | 206/222 |
| 3,768,697 | 10/1973 | Lerner | 222/80 D |
| 3,840,136 | 10/1974 | Lanfranconi et al. | 222/83.5 X |
| 3,968,872 | 7/1976 | Cavazza | 604/416 X |
| 4,011,288 | 3/1977 | Assenheimer et al. | 222/83.5 X |
| 4,088,246 | 5/1978 | Klingaman | 222/88 |
| 4,132,308 | 11/1979 | Goncalves | 206/219 |
| 4,294,351 | 10/1981 | Cheetham | 206/222 |
| 4,550,825 | 11/1985 | Sutryn et al. | 206/222 |
| 4,615,437 | 10/1986 | Finke et al. | 215/DIG. 8 |
| 4,624,393 | 11/1986 | Lopez | 222/83.5 |
| 4,705,191 | 11/1987 | Itzel et al. | 222/80 |
| 4,813,578 | 3/1989 | Gordon et al. | 222/541 |

*Primary Examiner*—Joseph J. Rolla
*Attorney, Agent, or Firm*—Charles E. Temko

[57] ABSTRACT

A threaded cap having an axially-disposed element containing an additive adapted to be engaged upon a threaded neck of a container. After the cap is tightened, the element is distorted resulting in release of the additive which is in liquid form into the container without spilling. In the disclosed embodiment, the element is ruptured by an axially aligned plunger which is manually operable by the user.

9 Claims, 2 Drawing Sheets

PUSH BUTTON CAP CONTAINING AN ADDITIVE FOR CONTAINERS

RELATED APPLICATION

Reference is made to my copending application Ser. No. 07/133,495 filed December 15, 1987 now U.S. Pat. No. 4,832,230, granted 4/23/89 entitled Threaded Cap Containing Additive for Containers, which application discloses and claims a related invention.

BACKGROUND OF THE INVENTION

This invention relates generally to the field of hand held liquid dispensers of a type used, for example, in the spraying of liquid insecticides, fungicides, window-cleaning solutions, and the like, and more particularly, it is directed to an improved charging device permitting the user to conveniently make a solution from a pre-measured liquid concentrate without the necessity of contacting the materials used and without the danger of spillage.

It is known in the art to provide dispensers containing a concentrate of soluble materials to a fixed quantity of solute, usually water, for dispensing as a spray upon an object to be treated. A typical device of this type is disclosed in U.S. Pat. No. 4,705,191 to Itzel, et al.

As disclosed in this patent, the concentrate is contained within a threaded cap which is ruptured as the cap is threadedly engaged upon the container containing the solute, permitting the contents to fall into the solute for mixing.

While not without considerable utility, this construction has several shortcomings, including the inability of the user to determine when rupture has occurred. Should the concentrate be of the same color as the solute, the user has no way of knowing that the concentrate has become released and dissolved or mixed with the solute without removing the charging device from the container.

Another problem lies in the fact that the point at which rupture of the capsule occurs depends upon the engagement of the capsule with portions of the threaded container which do not effect a sealing relation between the cap and the container. Thus, it is possible to have the capsule rupture before the cap is completely engaged upon the neck of the container, and if, at that point, the container is shaken, or otherwise manipulated for mixing, leakage of the contents of the container may occur.

SUMMARY OF THE INVENTION

Briefly stated, the invention contemplates the provision of an improved device of the class described in which the above-mentioned disadvantages have been substantially eliminated. To this end, the disclosed embodiment comprises a threaded cap containing a capsule capable of relative axial movement with respect to the outer threaded body of the cap, the capsule itself including a pair of relatively movable parts, one part of which forms a manually depressible plunger which projects through a centrally positioned opening in an upper wall of the threaded cap body. A second part is adapted to contact the free edge of the neck of the container so that when the threaded part of the cap is engaged, the capsule is elevated within the threaded cap to indicate that the cap is fully engaged with the neck, following which the user presses upon the exposed part of the capsule to rupture a lower wall thereof, and allow the contents of the capsule to drain into the container with assurance that no leakage will occur.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 4:
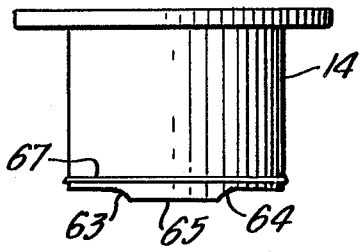
FIG. 4 is a side elevational view corresponding to the upper portion of FIG. 3.
Figure 5:
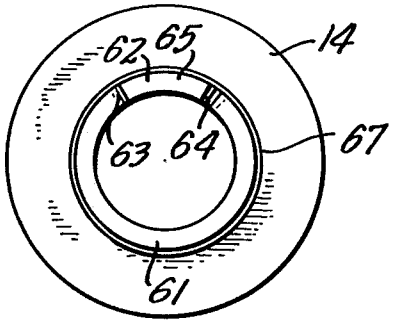
FIG. 5 is a bottom plan of the element shown in FIG. 4.
Figure 3:
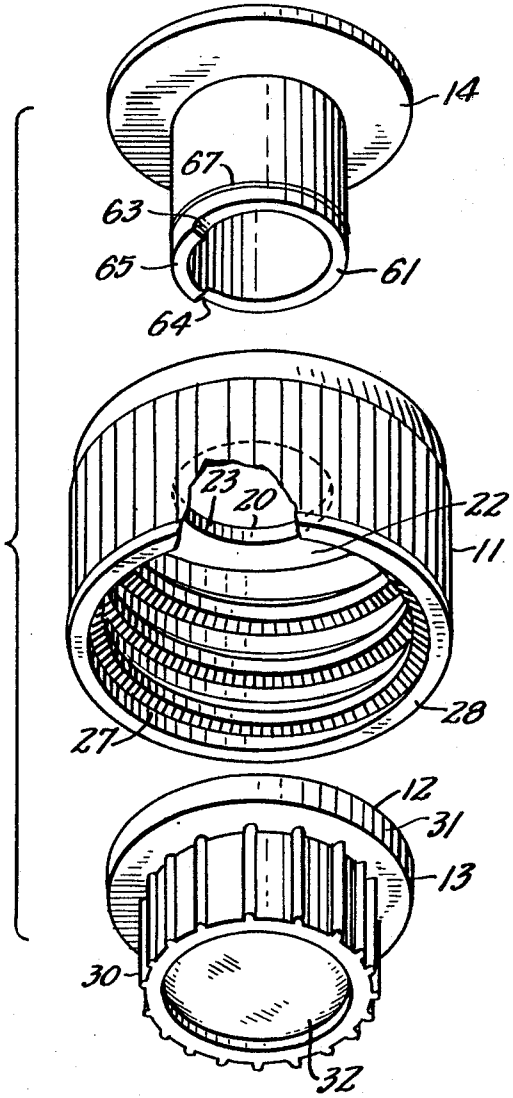
FIG. 3 is an exploded perspective view thereof.
Figure 1:
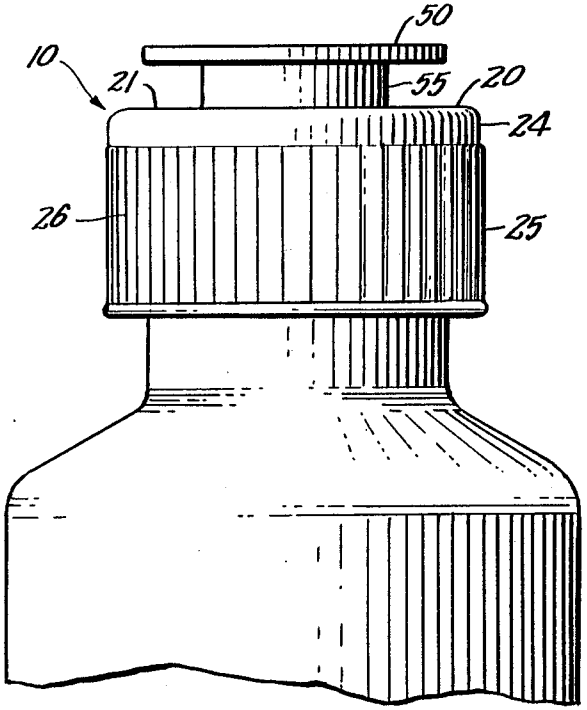
FIG. 1 is a fragmentary side elevational view of a threaded cap embodying the invention.
Figure 2:
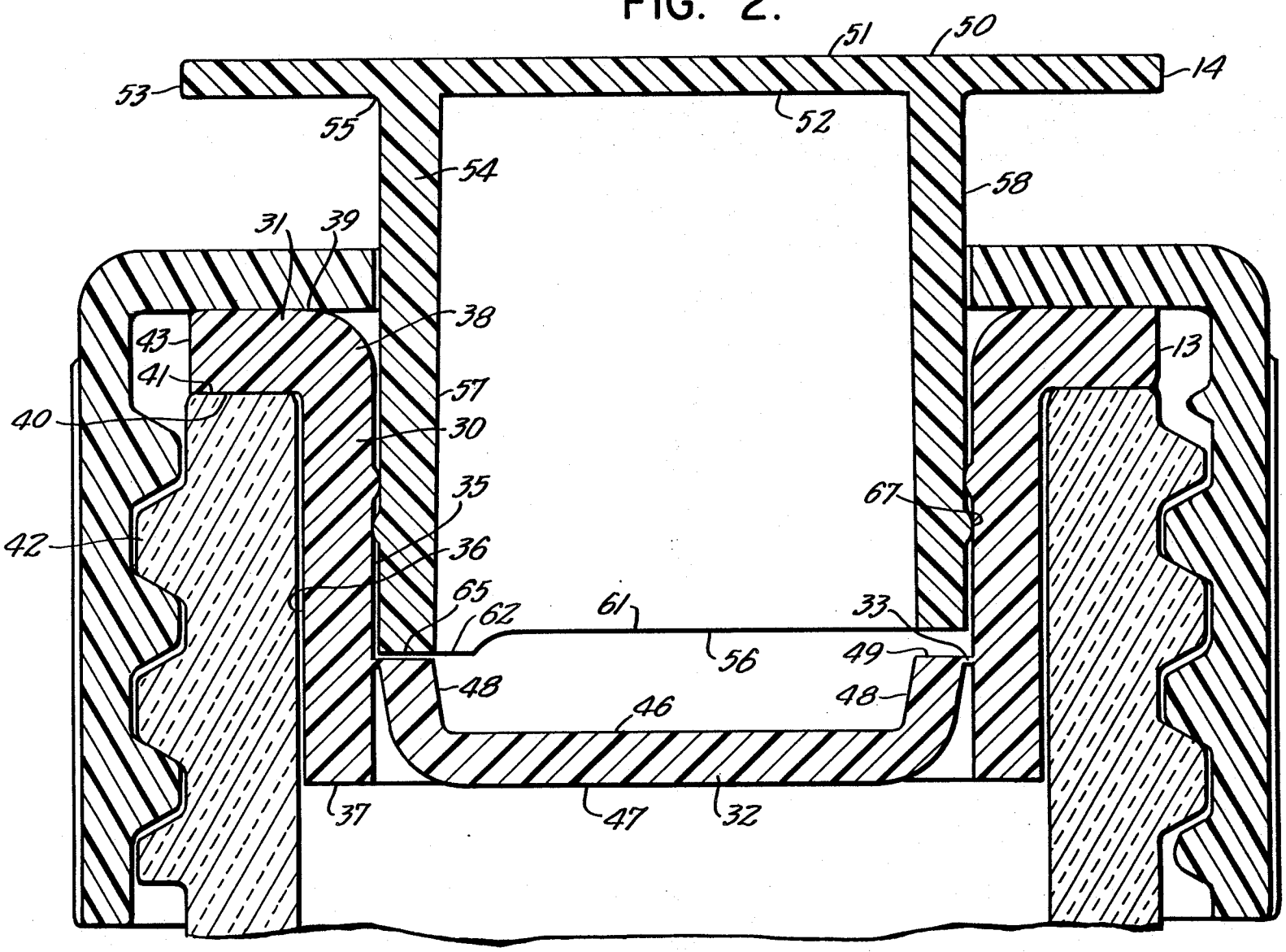
FIG. 2 is a fragmentary longitudinal central sectional view thereof.

In accordance with the invention, the device, generally indicated by reference character 10, comprises broadly: an outer cap 11, and a capsule element 12 including a first lower member 13 and a second upper member 14.

The outer cap 11 is formed as a single molding from synthetic resinous materials, and includes an upper end wall 20 bounded by an outer surface 21, an inner surface 22, a circular centrally disposed opening 23 and a peripheral edge 24. Extending from the edge 24 is a cylindrical side wall 25 bounded by an outer surface 26, a threaded inner surface 27 and a lower circular edge 28.

The first lower member 13 is most suitably formed as a molding of polyethylene, and includes a cylindrical side wall 30 having a radially extending flange 31 at an upper end thereof, and a lower wall 32 frangibly interconnected in a circular area 33 thereto. This area is preferably approximately 0.006 inches in thickness.

The side wall 30 includes an inner surface 35 and an outer surface 36 meeting at a lower end 37. An upper end 38 merges with the flange 31 which flange includes an upper surface 39 selectively meeting with the inner surface 22, and a lower surface 40 which is adapted to rest upon an end edge 41 of a threaded neck 42 of a container. A peripheral edge 43 is of dimension enabling it to clear the threaded inner surface 27 of the cap 11.

The lower wall 32 is bounded by an upper surface 46, a lower surface 47, and an angularly disposed peripheral portion 48, an edge 49 of which forms the interconnection 33.

The second upper member 14 is most suitably formed from polypropylene, so as to be of somewhat greater durometer or rigidity than the member 13. It includes an upper wall 50 which forms a manually engageable push button, bounded by an upper surface 51, a lower surface 52 and a peripheral edge 53. Extending downwardly from the lower surface 52 is a cylindrical shank 54 bounded by an upper edge 55, a lower edge 56, an inner surface 57 and an outer surface 58. Formed on the outer surface 58 adjacent the lower edge 56 is an integral sealing ring 67 which slideably engages the inner surface 35 and prevents leakage therepast.

The lower edge 56 is of non-uniform profile, and includes a first arcuate portion 61 extending over approximately 300°, and a second portion 62 extending over the remainder of the circle, the portion 62 having first and second sloping portions 63 and 64 leading to a plateau 65 disposed therebetween. The second portion extends from the plane of the first portion approximately 0.050 inches where the diameter of the shank is approximately 5/8 inches.

The operation of the device will be apparent from a consideration of the drawings. The user, after filling the container containing the solute, engages the device 10 upon the threaded neck of the container, generally indicated by reference character 70, and threads the former on the latter until the flange 31 forms a seal between th neck of the container and the cap 11. When this occurs, continued rotation will cause the capsule element 12 to move upwardly relative to the cap 11 a short distance while maintaining the seal of the cap on the threaded neck. This movement causes the upper wall 50 to rise relative to the upper surface of the end wall 20 and form a push button which may be subsequently manually engaged by the user. At this point, the user is aware that the cap 11 is fully engaged, and then, while holding the container, the user presses downwardly on the upper surface 51 causing the member 14 to move downwardly relative to the member 13. Very little movement is necessary to cause the edge 56 to core into contact with the frangible area adjacent the edge 49, and an initial separating action is caused by the portion 62. Further downward movement results in a complete severence of the interconnection 33, following which the contents of the capsule element drains into the container. This severence can be determined by the fact that the upper wall 50 is now in a position where it juxtaposes the outer surface 21. At this point, the container may be shaken to mix the contents of the capsule element with the solute within the container prior to use.

At the completion of the dispensing of the contents of the container, the device 10 is removed, following which the container may be recharged and another unused device 10 positioned upon the threaded neck of the container for a repetition of the above procedure.

It may be observed that a superior cutting action is obtained when the edge 62 is shaped to include the plateau 65, as contrasted with the forming of the edge such that it would come to a definite point, for the reason that the material comprising the member 14 is not very rigid, it being merely somewhat more rigid than the material forming the first member 13. I have found that it is preferable to provide a small plateau 65 which will not distort under pressure, and which, nevertheless, permits the concentration of the manually exerted force to be applied to a relatively short segment forming the arcuate frangible interconnection 33. Once an intial rupture has been accomplished, the remaining portions of the frangible interconnection 33 are readily severed without difficulty.

It may thus be seen that I have invented novel and highly useful improvements in cap-type charging elements of the class described, in which at least some of the problems encountered with the use of prior art devices have been eliminated. By the use of my device, it is possible for a user to determine that the outer cap is fully seated in sealed relationship before attempting to rupture the capsule element, this being determined by the fact that the capsule element rises as the cap is tightened. The user is also able to determine that once the cap is fully seated, no leakage is possible when the capsule is ruptured. The capsule is ruptured by a positive manual movement on the part of the user which enables him to determine that the contents of the capsule have been discharged into the container for mixing. Once the upper member 14 has been pushed downwardly to the limit of its path of travel, the user determines at what point shaking of the container is necessary.

The manufacture of the component parts of the device is considerably less complicated than is the case where the capsule is ruptured by the interaction of structure on the cap and the threaded neck of the container. Consequently, the number of parts to be independently molded has been substantially reduced, and they are of a configuration which enables the maintenance of very close commercial tolerances.

I wish it to be understood that I do not consider the invention to be limited to the precise details of structure shown and set forth in this specification, for obvious modifications will occur to those skilled in the art to which the invention pertains.

I claim:

1. In a combination of a container having a threaded neck forming an opening communicating with the interior of said container and a liquid dispensing element selectively threaded upon said neck element, the improvement comprising said liquid dispensing element including an outer cap having a planar end wall having a central opening therethrough, and a cylindrical internally threaded side wall; a capsule element having a first lower member and a second upper member slideably engaged therewith; said first lower member including a cylindrical side wall having a radially extending flange at an upper end thereof forming a seal between said threaded neck of said container and said outer cap, and a lower wall frangibly interconnected to said last-mentioned cylindrical side wall at a lower end thereof; said second upper member including an upper wall and a cylindrical hollow shank having a principal axis perpendicular to the plane of said upper wall and penetrating said opening in said planar end wall of said cap, said shank having a lower free edge overlying an area of frangible interconnection between said lower wall and said cylindrical side wall of said second upper member; said capsule element being positioned within said cap such that said upper wall of said second upper member contacts said upper end wall of said cap, engagement of said cap with said threaded neck of said container serving to elevate said capsule element relative to said cap and move said upper wall of said second upper member into spaced relation relative to said planar end wall; whereby downward pressure exerted upon said upper wall serves to cause movement of said shank relative to said lower wall of said first lower member to sever the frangible interconnection between said lower wall and said cylindrical side wall.

2. The combination set forth in claim 1, further characterized in said cylindrical side wall having a radially extending flange at an upper end thereof forming a gasket between said cap and said threaded neck of said container.

3. The combination set forth in claim 1, further characterized in said free edge of said shank being of nonplanar configuration, and having an arcuate segment thereof adapted to contact said lower wall in advance of the remaining portions of said lower edge to facilitate severing of said frangible area,

4. The combination set forth in claim 3, further characterized in said arcuate segment defining a cutting edge extending over approximately sixty degrees.

5. The combination set forth in claim 3, further characterized in said frangible area comprising an arcuatelyshaped web of material of thickness approximating 0.006 inch.

6. The combination set forth in claim 3, further characterized in said shank having an outer cylindrical surface and a circular sealing rib on said outer surface providing sliding contact with said first upper member.

7. The combination set forth in claim 3, further characterized in said first lower member being formed of polyethylene, and said second upper member being formed of polypropylene.

8. An improved cap-type charging device for use upon a threaded neck of a container comprising an outer cap and a capsule element slideably engaged therein; said cap including an internally threaded cylindrical wall adapted to selectively engage said threaded neck, and an upper end wall having a centrally disposed circular opening extending therethrough; said capsule element including a first lower member having a cylindrical side wall, a bottom wall frangibly interconnected to said side wall at a lower end thereof, and a radially extending flange at an upper end thereof; said capsule element further including a second upper member having a planar upper wall and a cylindrical hollow shank having a principal axis perpendicular to said upper wall, said shank projecting through said opening in said end wall and slideably engaging an inner surface of said cylindrical side wall of said first lower member, said shank having a free arcuate edge positioned adjacent an area of frangible interconnection between said cylindrical side wall and said bottom wall.

9. A cap-type charging device as set forth in claim 8, further characterized in said lower edge of said shank having an arcuate segment projecting longitudinally from the remaining portions thereof to form a cutting edge for facilitating the separation of said bottom wall from said cylindrical side wall.

* * * * *